US007751734B2

(12) United States Patent
Mestha et al.

(10) Patent No.: US 7,751,734 B2
(45) Date of Patent: Jul. 6, 2010

(54) COLOR SENSOR TO MEASURE SINGLE SEPARATION, MIXED COLOR OR IOI PATCHES

(75) Inventors: Lalit K. Mestha, Fairport, NY (US); Tonya L. Love, Rochester, NY (US); Daniel A. Robbins, Williamson, NY (US); Dennis M. Diehl, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 917 days.

(21) Appl. No.: 11/535,385

(22) Filed: Sep. 26, 2006

(65) Prior Publication Data

US 2008/0075492 A1 Mar. 27, 2008

(51) Int. Cl.
*G03G 15/00* (2006.01)

(52) U.S. Cl. ..... 399/49

(58) Field of Classification Search ..... 399/39, 399/49, 74, 15, 60, 53, 72

See application file for complete search history.

(56) References Cited

U.S. PATENT DOCUMENTS

| | | | | |
|---|---|---|---|---|
| 5,471,313 | A * | 11/1995 | Thieret et al. | 358/296 |
| 6,035,103 | A * | 3/2000 | Zuber | 358/1.9 |
| 6,035,152 | A * | 3/2000 | Craig et al. | 399/49 |
| 6,295,130 | B1 | 9/2001 | Sun et al. | |
| 6,351,308 | B1 | 2/2002 | Mestha | |
| 6,384,918 | B1 | 5/2002 | Hubble, III et al. | |
| 6,463,227 | B1 * | 10/2002 | Denton et al. | 399/49 |
| 6,538,770 | B1 | 3/2003 | Mestha | |
| 6,603,551 | B2 | 8/2003 | Mestha et al. | |
| 6,633,382 | B2 * | 10/2003 | Hubble et al. | 356/402 |
| 6,690,471 | B2 * | 2/2004 | Tandon et al. | 356/420 |
| 6,721,692 | B2 | 4/2004 | Mestha et al. | |

(Continued)

FOREIGN PATENT DOCUMENTS

DE 10218068 A1 * 11/2002

(Continued)

OTHER PUBLICATIONS

Lalit K. Mestha, "Control Advances in Production Printing and Publishing Systems," *Proceedings of the International Conference on Digital Printing Technologies (NIP20)*, The Society for Imaging Science and Technology, Oct. 31-Nov. 5, 2004.

(Continued)

*Primary Examiner*—Robert Beatty
(74) *Attorney, Agent, or Firm*—Oliff & Berridge, PLC

(57) ABSTRACT

A marking engine forms one or more toned patches and/or images on a photoreceptor transfer device such as a photoreceptor belt or drum, either within or outside a main image area. A sensor illuminates the tones patches and/or images on the photoreceptor transfer device using wavelengths outside the photo response range of the photoreceptor transfer device, thereby allowing reflectance values for each toned patch and/or image to be measured without generating ghost images on the photoreceptor transfer device. The sensor supports collection of measured reflectance values from single-color, mixed-color; and multi-separation image-on-image toned patches and/or images directly from the photoreceptor transfer device at rates as high as one or more times per revolution of the photoreceptor transfer device. The measured reflectance values may be used to generate and/or update color stabilization tone reproduction curves.

23 Claims, 11 Drawing Sheets

U.S. PATENT DOCUMENTS

| | | | | |
|---|---|---|---|---|
| 6,774,999 | B2 * | 8/2004 | Franzen et al. | 356/425 |
| 6,809,855 | B2 | 10/2004 | Hubble, III et al. | |
| 6,975,949 | B2 | 12/2005 | Mestha et al. | |
| 7,239,819 | B2 * | 7/2007 | Gross et al. | 399/49 |
| 7,307,752 | B1 * | 12/2007 | Mestha et al. | 358/1.9 |
| 7,548,705 | B2 * | 6/2009 | Morales et al. | 399/49 |
| 2004/0136013 | A1 | 7/2004 | Mestha et al. | |
| 2004/0136015 | A1 | 7/2004 | Van De Capelle et al. | |
| 2005/0160092 | A1 | 7/2005 | Mestha et al. | |
| 2006/0132787 | A1 | 6/2006 | Mestha et al. | |
| 2006/0197966 | A1 | 9/2006 | Viturro et al. | |
| 2006/0251437 | A1 * | 11/2006 | Donaldson | 399/49 |

FOREIGN PATENT DOCUMENTS

| | | |
|---|---|---|
| EP | 1 288 640 | 3/2003 |

OTHER PUBLICATIONS

PK Gurram et al., "Comparison of 1-D, 2-D and 3-D Printer Calibration Algorithms with Printer Drift," *IS&T's 21st International Conference on Digital Printing Technologies* (*NIP21*), Baltimore, MD, Sep. 18-22, 2005.

Lalit K. Mestha et al., "Low Cost LED Based Spectrophotometer," *ICIS '06, International Congress of Imaging Science*, Rochester, New York, May 7-12, 2006.

Lalit K. Mestha et al., "Array Based Sensor to Measure Single Separation or Mixed Color (or IOI) Patches on the Photoreceptor Using MEMS Based Hyperspectral Imaging Technology," filed Sep. 26, 2006.

Lalit K. Mestha et al., "Mems Fabry-Perot Inline Color Scanner For Printing Applications Using Stationary Membranes," filed Sep. 26, 2006.

Lalit K. Mestha et al., U.S. Appl. No. 09/566,291, "Online Calibration System for a Dynamically Varying Color Marking Device," filed May 5, 2000.

Lalit K. Mestha et al., U.S. Appl. No. 11/092,635, "Two- Dimensional Spectral Cameras and Methods for Capturing Spectral Information Using Two-Dimensional Spectral Cameras," filed Mar. 30, 2005.

R. Enrique Viturro et al., U.S. Appl. No. 11/097,727, "Online Gray Balance Method with Dynamic Highlight and Shadow Controls," filed Mar. 31, 2005.

Pinyen Lin et al., U.S. Appl. No. 11/319,276, "Fabry-Perot Tunable Filter Systems and Methods"; filed Dec. 29, 2005.

Pinyen Lin et al., U.S. Appl. No. 11/319,389, "Reconfigurable MEMS Fabry-Perot Tunable Matrix Filter Systems and Methods"; filed Dec. 29, 2005.

Lalit K. Mestha et al., U.S. Appl. No. 11/319,395, "Systems and Methods of Device Independent Display Using Tunable Individually-Addressable Fabry-Perot Membranes"; filed Dec. 29, 2005.

Lalit K. Mestha et al., U.S. Appl. No. 11/405,941, "Projector Based on Tunable Individually-Addressable Fabry Perot Filters," filed Apr. 18, 2006.

Lalit K. Mestha et al., U.S. Appl. No. 11/406,030, "Fabry-Perot Tunable Filter," filed Apr. 18, 2006.

R. Enrique Viturro et al., U.S. Appl. No. 11/428,489, "Pitch-to-Pitch Online Array Balance Calibration," filed Jul. 3, 2006.

* cited by examiner

COLOR SENSOR TO MEASURE SINGLE SEPARATION, MIXED COLOR OR IOI PATCHES

CROSS-REFERENCE TO RELATED APPLICATIONS

This application is related to U.S. patent application Ser. No. 10/248,387, filed on 15 Jan. 2003, and entitled, "Systems and Methods for Obtaining a Spatial Color Profile and Calibrating a Marking System;" U.S. patent application Ser. No. 10/342,873, filed on 15 Jan. 2003, and entitled, "Iterative Printer Control and Color Balancing System and Method Using a High Quantization Resolution Halftone Array to Achieve Improved Image Quality with Reduced Processing Overhead;" U.S. patent application Ser. No. 09/566,291, filed on 5 May 2000, and entitled, "Online Calibration System for a Dynamically Varying Color Marking Device;" U.S. patent application Ser. No. 11/070,681, filed on 2 Mar. 2005, and entitled, "Gray Balance for a Printing System of Multiple Marking Engines;" U.S. patent application Ser. No. 11/097,727, filed on 31 Mar. 2005, and entitled, "Online Gray Balance Method with Dynamic Highlight and Shadow Controls;" U.S. Pat. No. 6,809,855, filed on 7 Mar. 2003 and entitled, "Angular, Azimuthal and Displacement Insensitive Spectrophotometer for Color Printer Color Control Systems;" U.S. Pat. No. 6,603,551, filed 28 Nov. 2001 and entitled, "Color Measurement of Angularly Color Variant Textiles;" U.S. patent application Ser. No. 11/428,489, filed 3 Jul. 2006 and entitled, "Pitch-to-Pitch Online Array Balance Calibration;" U.S. patent application Ser. No. 11/535,382, filed 26 Sep. 2006 and entitled, "MEMS Fabry-Perot Inline Color Scanner For Printing Applications Using Stationary Membranes;" and U.S. patent application Ser. No. 11/535,400, filed 26 Sep. 2006 and entitled, "Array Based Sensor to Measure Single Separation or Mixed Color (or IOI) Patches on the Photoreceptor Using MEMS Based Hyperspectral Imaging Technology." The disclosures of the related applications are incorporated by reference in their entirety.

BACKGROUND

This disclosure generally relates to light sensor devices for use in marking methods and systems.

This disclosure refers to "marking" as a process of producing a pattern, such as text and/or images, on substrates, such as paper or transparent plastic. A marking engine may perform the actual marking by depositing ink, toner, dye, or any other suitable marking material on the substrate. For brevity, the word "toner" will be used to represent the full range of marking materials, and is used interchangeably with the terms for other identifying materials in the full range of marking materials.

A popular marking engine is the xerographic marking engine used in many digital copiers and printers. In such a xerographic mar king engine, a photoreceptor unit, such as, for example, a belt or roller, whose electrostatic charge varies in response to being exposed to light, is placed between a toner supply and the substrate. In systems including xerographic marking engines, the toner is typically an electrostatically chargeable or electrostatically attractable toner. A laser unit, bank of light emitting diodes, or other such light source, is used to expose the photoreceptor unit to light to form an image of a pattern to be printed on the photoreceptor unit. In simple, monochromatic xerographic marking engines, single color toner is electrostatically attracted to the image on the photoreceptor unit to create a toner image on the photoreceptor unit. The toner image is then transferred to the substrate from the photoreceptor unit. Different methodologies are then employed to heat-set, or otherwise "fuse," the toner image onto the substrate.

In more complex systems, multiple colors of toner are applied. General categories of more complex color systems include those that are referred to as image On Image (IOI) systems and/or tandem systems. In an IOI system, such as that shown schematically in exemplary manner in FIG. 1, the marking engine 10 includes a plurality of primary color applying units 11 that deposit toner on a photoreceptor belt 13, which includes multiple image forming areas 14, hereafter pitches 14. A first pitch 14 of the photoreceptor belt 13 receives a first toner image in a first color. The first color remains on the photoreceptor belt 13 while second (and subsequent) toner images are created by applying second (and subsequent) colors atop the first image in the same pitch 14. The first and second (and subsequent) toner images remain on the photoreceptor belt 13 and are subsequently built up on the photoreceptor belt 13. Once all of the toner images are placed on the photoreceptor belt 13, they are then transferred to a substrate, typically paper, and fused to the substrate. Furthermore, after the first pitch 14 has passed one of the color applying units 11, the next pitch 14 comes into alignment with that color applying unit 11, and the image forming process starts again in the next pitch 14.

In an embodiment of a tandem system architecture, such as that shown in exemplary manner in FIG. 2, the marking engine 20 includes multiple primary color applying units 21 that first deposit their toner on respective photoreceptor drums 22 to form toner images. These toner images are deposited on an intermediate transfer belt (ITB) 23, which includes multiple pitches 24. Each toner image is transferred onto the ITB 23 before the next toner image is formed. Like in the IOI system, the toner images are transferred to a substrate once all toner images for a given pitch have been deposited on the ITB 23.

In a variant of the tandem system shown in FIG. 2, an additional drum may be included between each photoreceptor drum 22 and the ITB 23. The additional drum accepts the toner image from the photoreceptor drum 22 and deposits it on the ITB 23. The inclusion of the additional drum aids in reducing a possibility of toner contamination by toner of one color getting into a toner source of another color due to electrostatic interaction between the toner image on the ITB 23 and the photoreceptor drums 22.

SUMMARY

Marking engines using any of the printing techniques described above seek to achieve consistency and reproducibility in generated output images. One approach by which consistency and reproducibility is effected is through the use of one or more image sensors to generate reflectance values from separate toned patches periodically output by the marking engine onto the photoreceptor unit and transferred to the substrate, based on stored test data. Measured reflectance values from a toned patch or an output substrate may be compared with stored target values and a difference value calculated. These difference values may be used to generate feedback control signals to the marking engine. In response to the feedback control signal, the marking engine may automatically adjust the amount of toner of one or more colors laid within one or more of the respective pitches that comprise an image to improve image quality, consistency and reproducibility.

Despite such feedback techniques, marking engines continue to suffer from color inconsistency or in stability that may affect a final image. Such color instability may be attributed to such factors as temperature, humidity, age and/or amount of use of the photoreceptor unit, age and/or use of an individual toner color, or other like environmental and/or mechanical factors.

Further, media attributes (e.g., media weight) can also affect color stability. For example, changes in media weight may result in a need to adjust fuser temperature, decurler penetration force, and acceleration profiles to achieve micron level registration tolerances.

Mechanical control systems may also contribute to color instability in certain circumstances. For example, color to color registration errors can lead to color instability. By way of example only, in some marking, systems, every pixel in all four color separations is registered on a image carrier to within, approximately, 85 microns. The placement of the separations is controlled by adjusting the speed of the photoreceptor belt, ROS position, and speed and location of the servo drive rolls. Color registration marks are placed on the photoreceptor and read with special sensors to produce a completely closed loop system that may achieve 40 micron accuracy of dot placement. However, such mechanical color to color registration processes are prone to error.

Control and sensor systems intended to correct color instability are not always effective in eliminating the color instability caused by such effects. For example, printers that use hierarchical control systems with Extended Toner Area Coverage Sensors (ETACS) are often unable to provide sufficient marking engine stability for multi-separation IOI images. This is because, ETAC sensors are used to measure tone development on the photoreceptor before transfer and fuse stages for three different input tone conditions, referred to, for example, as low, mid and high area coverage, resulting in a photoreceptor developability control model with 3 states. However, although ETACS may be used in such a manner to measure color of single color control patches, ETACS do not measure color of multi-separation control patches accurately.

On-paper color measurements with image sensors, and specifically spectrophotometers, were believed to constitute a fix for this problem. On-paper spectrophotometer color measurements may be performed within a marking system as an integral part of the marking system image generation process, i.e., "in-line", or performed in a process separate from the marking system image generation process, i.e., "off-line." Both in-line and off-line on-paper spectrophotometric measurements may be used in various forms to construct 1D gray balance calibration tone reproduction curves (TRCs) and/or 2D, 3D or 4D correction Look-Up-Tables (LUTs). These TRCs and/or LUTs may be used by a marking engine to automatically adjust the amount of toner of one or more colors laid within one or more of the respective pitches that comprise an image to improve image quality, consistency and reproducibility, as addressed above. A drawback of on-paper spectrophotometer measurement techniques is the inability of the marking engine to correct colors at a sufficiently high frequency, e.g., every belt revolution, to achieve color stabilization as is supported by the hierarchical control systems addressed above.

This disclosure describes various exemplary embodiments of an image sensor to include a spectrophotometer for non-invasively measuring single color or multi-separation color toned patches directly from a photoreceptor unit at a high monitoring rate. This disclosure will generally refer to the photoreceptor unit as a belt. The use of the term photoreceptor belt in this manner is for ease of understanding and clarity. It should not be regarded in any way as limiting or excluding other types of photoreceptor units, such as, for example, photoreceptor drums. The frequency sought to be achieved in toned patch monitoring of such a photoreceptor belt in operation is one or more measurements per belt cycle, with increased measurement accuracy.

Non-invasive measurement of toned patches at the photoreceptor belt rotation speed invariably requires some kind of illumination. Embodiments of the disclosed sensor illuminate toned patches using one or more illumination bands that are outside of the photo-generation response range of the photoreceptor belt upon which the toned patches are placed.

A common print quality problem in xerographic printing results from a build-up of residual potential and surface voltage on photoreceptors. Such a condition results in a vestigial image repeated at regular intervals down the length of a page and appearing as light or dark areas (in black and white printers) or often colored area in (color printers) relative to the surrounding field, referred to as ghosting. There are many sources of ghosting. Subsystems from charging, development, photoreceptor, to fusing can all produce ghosting.

Photo-generation of charge carriers in a photoreceptor belt takes place at the bottom of a charge generation layer when the photoreceptor belt is exposed with photons. The charge generation layer has photoconduction material that generates electron-hole pairs in response to the photons. These charges drift and migrate to the top surface, and neutralize the surface charges in the illuminated areas to form latent electrostatic images when the photoreceptor belt is exposed with images or toned patches. The strength of the photo generation response depends on a wavelength of the photons.

FIG. 3 presents a graphical plot 30 of the spectral sensitivity of an exemplary photoreceptor belt used in an exemplary marking engine. As shown in FIG. 3, photo generation of the photoreceptor belt has minimum electron-hole pair generation at ~470 nm and above 900 nm (infrared). Threshold line 32 marks an exemplary threshold below which ghosting is not observed in subsequent toned patches and/or images.

Therefore, exemplary embodiments of the disclosed sensor for use in non-invasively measuring toned single color or multi-separation color toned patches on a photoreceptor belt may illuminate the toned patches on the photoreceptor belt with the spectral sensitivity shown in FIG. 3, particularly employing illumination bands centered at ~470 nm and above 900 nm, without affecting the charge generation layer of the photoreceptor belt. In this manner, the toned patches on the photoreceptor belt may be illuminated and a corresponding reflected light response measured, without introducing ghost images.

Exemplary embodiments of the disclosed sensor may be based upon the Low Cost LED Based Spectrophotometer (LCLEDS) technology, which is currently used to measure single color and multi-separation color toned patches on output substrates, such as white paper, in support of on-paper color stabilization processes. Further, exemplary embodiments of the disclosed sensor may be based on LCLED housing and optics technology to provide displacement invariance to photoreceptor movements.

Exemplary embodiments of the disclosed sensor may sequentially illuminate toned patches with LEDs at specific wavelengths, such as: (1) one or more LEDs that produce a narrow illumination hand centered at a wavelength within a first low photosensitivity region of the photoreceptor belt, e.g., below 525 nm, such as an LED that produces a narrow illumination band centered around 470 nm; and (2) one or more LEDs that produce a narrow illumination band centered at a wavelength within a second low photosensitivity region of the photoreceptor belt, e.g., above 900 nm, such as an LED that produces a narrow illumination band centered around 940 nm and/or an LED that produces a narrow illumination band centered around 970 nm.

Based upon preliminary tests, exemplary embodiments of the disclosed sensor may be used to measure light reflectance from toned patches on a photoreceptor belt of a variety of colors throughout the color gamut. These measurements may, in turn, be used to generate measured reflectance values that may be used to characterize the toned patch. These measured reflectance values may be compared with a set of desired reflectance values and used to produce and/or update a color correlating TRC. The TRC may then be used to alter a theoretical combination of toner to produce more accurate, or at least color truer to a stored reflectance value, with an actual combination of toner.

For example, should a process color of 128 cyan, 64 magenta, 64 yellow and 0 black be desired, a marking engine may need to be adjusted to employ 131 cyan, 67 magenta, and 69 yellow, and 0 black to achieve the desired result. Reference to TRCs may be made to adjust requested amounts of each color so that the marking engine deposits 131 cyan, 67 magenta, 69 yellow and 0 black, yielding the desired process color (128, 64, 64, 0). Preferably, a different TRC is used for each toner that a marking engine uses so that a CMYK marking engine will have four TRCs. TRCs can have different ranges of saturation values, such as 0 to 1, 0 to 100, or 0 to 255. Regardless of the input range and output range, TRCs are used to adjust the amount of toner deposited by mapping an input value to an output value.

Exemplary embodiments of the disclosed sensor, using multiple illumination bands, may be capable of supporting multi-axis color control of a marking engine at a relatively high frequency, e.g., every photoreceptor belt cycle. As discussed above, this rate is higher than the update frequency currently possible with on-paper measurements. The sensors may be used to measure single color, mixed-color and/or IOI patches to enable multi-axis color control of a wide range of marking engines. Further, by using LCLED technology the cost of the approach may be relatively low. The low cost of the approach may allow color control features, previously reserved for only high-end printing systems to be considered for use in less expensive printing systems.

These and other objects, advantages and features are described in or apparent from the following description of embodiments.

BRIEF DESCRIPTION OF THE DRAWINGS

Exemplary embodiments will be described with reference to the accompanying drawings, where like numerals represent like parts, and in which.

DETAILED DESCRIPTION OF EMBODIMENTS

To obtain a desired color on a target media, such as white paper, different amounts of base colors or marking materials, such as cyan, magenta and yellow, are marked on a photoreceptor unit or belt in preparation for transfer to the target media. A well-balanced marking engine should produce a pitch with color reflectance values which, when measured, match reflectance values that correspond to the desired color. However, a marking engine may not produce an exact desired color due to, among other factors, variations in color pigments of the primary colors used by the marking engine, and/or internal processes of the marking engine. To overcome such shortfalls, color balance TRCs may be developed by iterative methods, such as those described above, and as disclosed in U.S. patent application Ser. Nos. 09/566,291, 11/070,681 and 11/097,727. These TRCs may be employed to, for example, adjust amounts of cyan, magenta and yellow proportions for all color tone values, taking into account the state of the materials and the marking engine. This approach can be extended to produce color balanced and/or gray balanced TRCs for spatial uniformity corrections as disclosed, for example, in U.S. patent application Ser. Nos. 10/248,387 and 10/342,873.

Iterative methods to produce accurate TRCs may rely upon feedback in the form of measured reflectance values from toned patches output by the marking engine in response to a set of predetermined, often stored, toned patch pattern data. By comparing measured reflectance values from toned patches produced on a photoreceptor belt with a stored set of desired reflectance values previously generated for the toned patch, TRCs may be created and/or updated. The created or updated TRCs may then be used by the marking engine to adjust and stabilize color output.

Calibration and control methodologies described above may be used to achieve high quality and consistent color balanced printing for marking engines with periodic pitch-to-pitch variations. To counter the effects of such factors as temperature, humidity, age and/or amount of use of the photoreceptor belt, age and/or use of an individual toner color, and other such related factors, TRCs are preferably continuously updated based on measured reflectance values that may be measured one or more times during a single revolution of a marking engine's photoreceptor belt. A sensor used to measure reflectance values would preferably be able to obtain accurate and useful measured reflectance values from the photoreceptor belt, at least once each revolution, without introducing ghost images on the photoreceptor belt. Direct measurement of such reflectance values from the photoreceptor belt yields accuracy and speed advantage discussed above over systems that measure reflectance values of toned patches on an output substrate.

Figure 4:
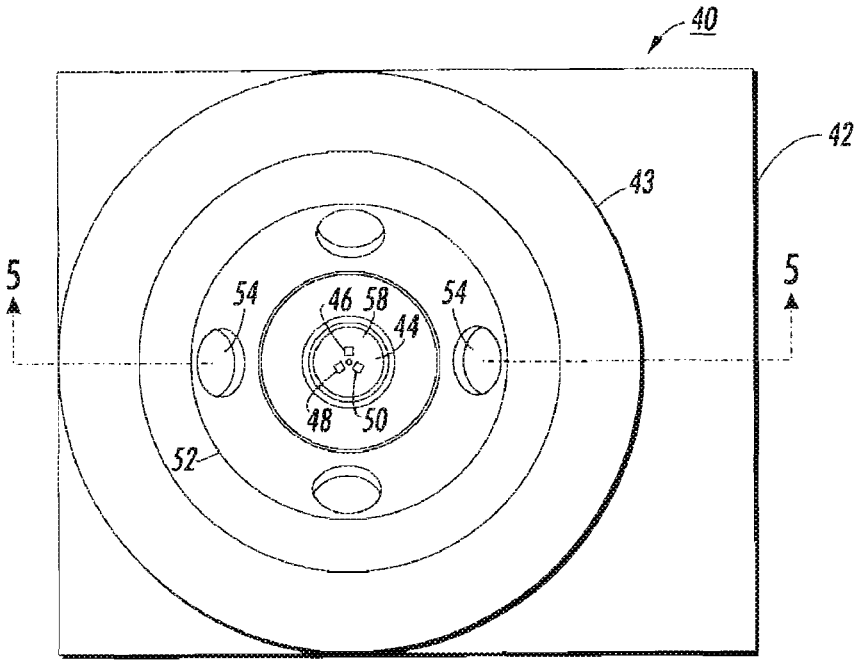
FIG. 4 is a top plan view of an exemplary sensor embodiment.

FIG. 4 is a top plan view of an exemplary embodiment of a sensor, such as a spectrophotometer that may use LCLEDS technology, to measure color reflectance values of toned patches produced by a marking engine on a photoreceptor belt. The measured reflectance values produced by such a sensor for a color toned patch may be compared with a stored set of desired reflectance values for the toned patch pattern used to produce the toned patch. The difference between the measured reflectance value and the desired reflectance value may be used by a processor to produce and/or update a TRC that may be stored and used by the marking engine to stabilize color output.

Figure 5:
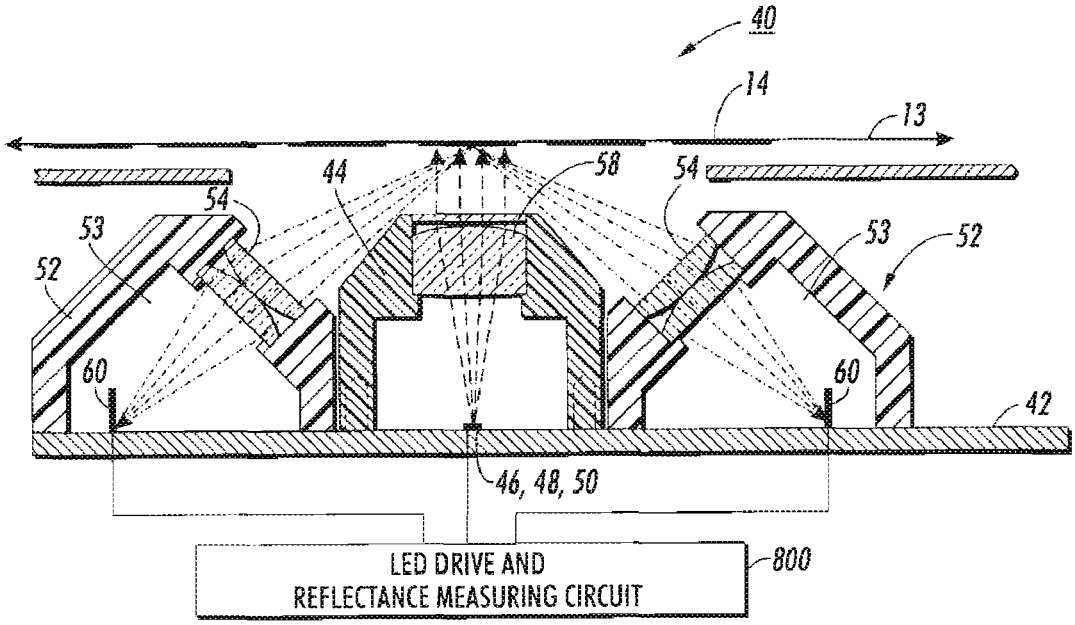
FIG. 5 is a cross-sectional view taken along the line 5-5 of the exemplary sensor embodiment of FIG. 4.

As shown in FIGS. 4 and 5, spectrophotometer 40 as an exemplary sensor may include an electronics housing 42 and a lens housing 43. Lens housing 43 may include an LED lens housing 44 and a light sensor lens housing 52. LED lens housing 44 may include a collimating lens 58 that collimates light emitted individually from each of, for example, a 470 nm LED 46, a 940 nm LED 48 and a 970 nm LED 50. Light sensor lens housing 52 may include any number of additional light sensor lenses 54. Additional details related to the physical structure and features of similar spectrophotometers are described in U.S. Pat. Nos. 6,809,855 and 6,603,551.

In operation, light emitted individually from each of exemplary 470 mm LED 46, 940 nm LED 48 and 970 nm LED 50 is reflected from a toned patch 14 (see FIG. 5) on, for example, a photoreceptor belt 13. The reflected light is focused by each of the respective light sensor lenses 54 onto a light sensor 60, e.g., a photodiode based light sensor, associated with each of the respective light sensor lenses 54.

As described in greater detail below, the intensity of the reflected light measured by each of the respective light sensors 60 may be integrated over the duration of illumination by each of the respective LEDs 46, 48, 50 to produce a measured reflectance value for the toned patch 14 for each LED frequency.

In operation, an exemplary spectrophotometer 40 may be positioned with respect to a photoreceptor belt 13 so that light individually emitted from each of LEDs 46, 48, 50, and passing through collimating lens 58, produces a collimated beam that is orthogonal to the photoreceptor belt 13 surface and the toned patches 14. Light reflecting from a single toned patch 14 on the photoreceptor belt 13 surface is reflected in all directions. Light reflected at approximately 45 degrees may be collected by each of the respective light sensor lenses 54 and focused by each light sensor lens 54 upon a light sensor 60 housed within light sensor lens housing 52.

FIG. 5 is a cross-sectional view of exemplary sensor, such as a spectrophotometer 40, taken along the 5-5 line shown in FIG. 4.

The exemplary spectrophotometer 40 embodiment shown in FIG. 5 is depicted measuring a reflectance value from a toned patch 14 on photoreceptor belt 13. Light emitted by one or more of LEDs 46, 48, or 50, is collimated by collimating lens 58 resulting in a collimated light beam that is orthogonal to and impacts upon the toned patch 14. Light reflected from toned patch 14 is reflected in all directions. As shown, the light sensor lenses 54, may be arranged at a 45 degree angle with respect to the collimated beam emitted from collimating lens 58. Configured in such a manner, the light sensor lenses 54 may receive light reflected from toned patch 14 at approximately a 45 degree angle and will focus the received light onto the light sensor 60.

As discussed in greater detail below, an LED drive and reflectance measuring circuit 800 may control which of LEDs 46, 48 and 50 is selected to emit light and may process measured reflectance signals and/or measured reflectance values from each of light sensors 60 held within a light isolated chamber 53 of light sensor housing 52. The light isolated chamber 53 shields light sensor 60 from all light except light that enters through the light sensor lens 54.

Figure 6:
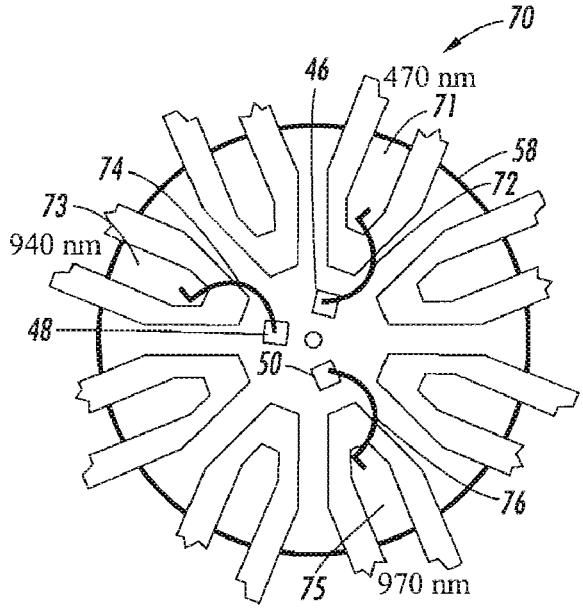
FIG. 6 is an enlarged plan view of the LED die shown at the center of the plan view of the exemplary sensor embodiment shown in FIG. 4.

FIG. 6 is an enlarged plan view of an LED die 70 protected by LED lens housing 44, as shown in the plan view of the exemplary sensor, spectrophotometer 40, presented in FIG. 4. As shown in FIG. 6, collimating lens 58 may be centered upon a cluster of three LEDs 46, 48, 50. In this manner, light emitted by each of the LEDs nay be received by collimating lens 58 and collimated, as described above. Further, as shown in FIG. 6, each of LEDs 46, 48 and 50 may be connected to a printed circuit electrode by a contact wire. For example, 470 nm LED 46 may be connected to a printed circuit electrode 71 by contact wire 72. 940 nm LED 48 may be connected to a printed circuit electrode 73 by contact wire 74 and 970 nm LED 50 may be connected to a printed circuit electrode 75 by contact wire 76. In this manner, each of the individual LEDs 46, 48, 50 may be selectively activated by a control circuit connected to each of the respective printed circuit electrodes 71, 73, 75, as described below with respect to FIG. 8.

Figure 7:
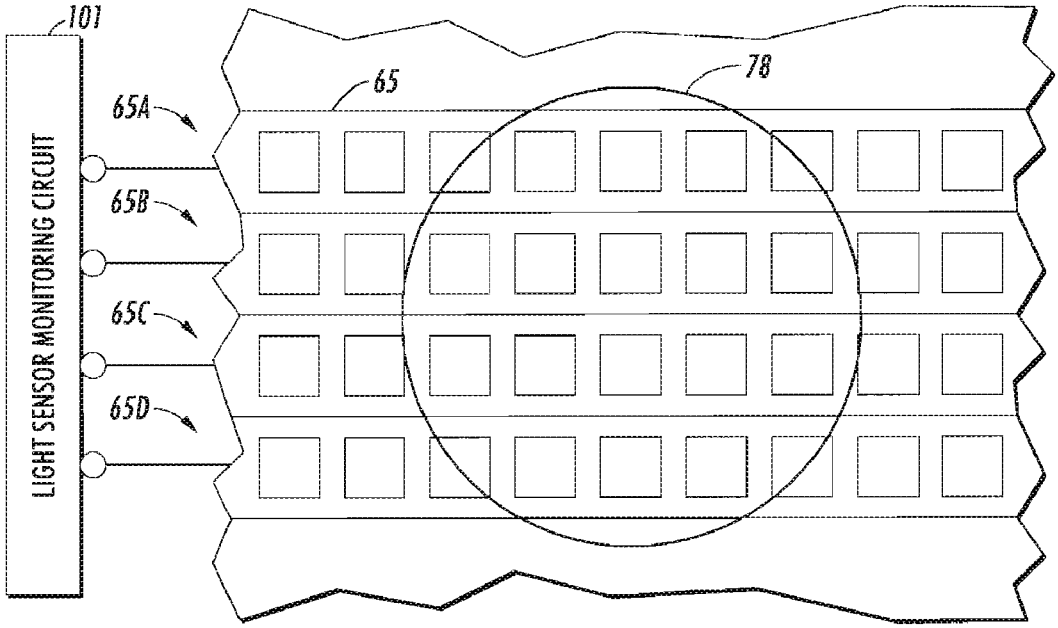
FIG. 7 is a greatly enlarged partial plan view of an exemplary multiple photo-site photodetector which may be included in an exemplary sensor.

FIG. 7 is a schematic and greatly enlarged partial plan view of an exemplary multiple photo-site light sensor which may be used in lieu of a conventional single photo-site light sensor in the exemplary sensor, spectrophotometer 40, shown in FIGS. 4 and 5. The light sensor shown in FIG. 7 may include an exemplary silicone colored image sensor array chip 65. Each row in the array chip, indicated in FIG. 7 as 65A, 65B, 65C and 65D, may be equipped with filters so that each light sensor row 65A-D receives light reflected from a toned patch that is within an assigned spectral band. Output from each of the respective light sensor rows 65A-D may be received by a light sensor monitoring circuit 101, as addressed in greater detail below. Further, as shown in FIG. 7, light focused by a light sensor lens upon light sensor 65 may be intensified within a light sensor illumination area 78 upon the surface of light sensor 65, by a light sensor lens, e.g., light sensor lens 54, as shown in FIGS. 4 and 5.

Figure 8:
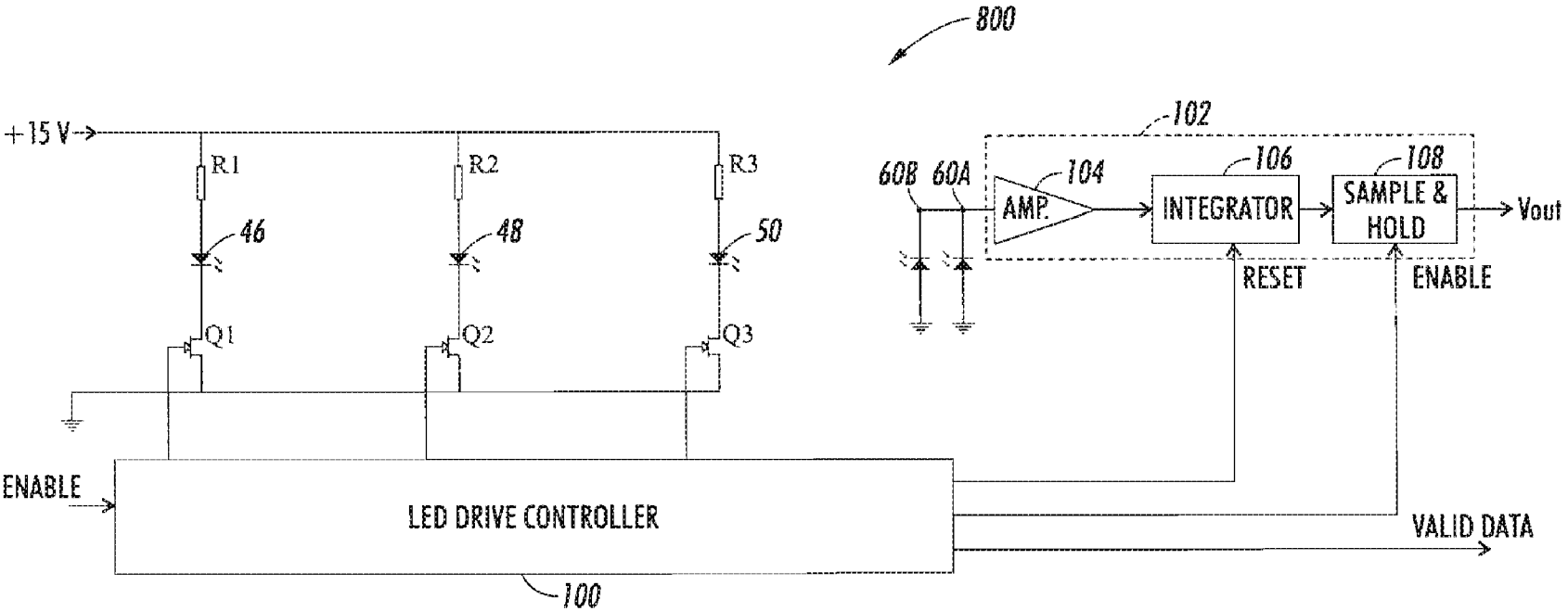
FIG. 8 schematically illustrates an exemplary embodiment of a circuit for operation of an exemplary sensor.

FIG. 8 schematically illustrates an exemplary LED drive and reflectance measuring circuit 800, as previously described with respect to FIG. 5. As shown in FIG. 8, LED drive and reflectance measuring circuit 800 may include an LED drive controller 100 and a reflected light processing circuit 102. Each of LEDs 46, 48 and 50 may be placed between a power source and ground, each LED in series with a resistor and a control transistor. A control line from LED drive controller 100 to each of the respective control circuits may be used by LED drive controller 100 to individually activate each of the individual LEDs, such as LEDS 46, 48, 50 shown in FIGS. 4 and 5.

As addressed above, each of LEDs 46, 48 and 50 may emit light within a different spectral band, e.g., a 470 nm centered band, a 940 nm centered band, and a 970 nm centered band, respectively. In response to regular timing signals from LED drive controller 100, each LED 46, 48 and 50 may be pulsed in turn by briefly turning on its respective transistor driver Q1 through Q3, by which the respective LEDs 46, 48 and 50 may be turned on by current from the indicated common voltage supply through respective resistors R1 through R3. Thus, each LED 46, 48, 50 may be sequenced one at a time to sequentially transmit light though the collimating lens 58 shown in FIGS. 4, 5 and 6. By emitting light at wavelengths outside a response range of the respective photoreceptor belt, the LEDs are able to illuminate a toned patch on a photoreceptor belt without introducing ghost images to the photoreceptor belt, as described above.

Also, as illustrated in the exemplary circuit in FIG. 8, the relative reflectance of a toned patch in response to the illuminating light emitted by each actuated LED wavelength may be measured by conventional circuitry including amplifier 104, integrator 106, and sample and hold circuit 108, and/or software for amplifying (104), integrating (106), and holding (108) the respective outputs of the light sensor 60. Integrator 106 may be reset by LED drive controller 100 before activating each of LEDs 46, 48 and 50 so that integrator 106 produces an integrated result based only upon light reflected from a toned patch in response to a single wavelength. Sample and hold circuit 108 may provide an output signal indicated here as $V_{out}$ when released by an enabling signal input shown from LED drive controller 100, which may also simultaneously provide an accompanying "Data Valid" signal.

FIG. 8 presents a single exemplary embodiment of an LED drive and reflectance measuring circuit. The circuit shown in FIG. 8, or various portions thereof, may be implemented by any known architecture such as, for example, an on-board hybrid chip or other similar circuit architecture. Since, the exemplary multiple photo-site light sensor 65 shown in FIG. 7 may have a built-in monitoring circuit 101, portions of the monitoring circuit 102 shown in FIG. 8, such as amplifier 104 and integrator 106, may not be needed in monitoring circuit 102 to produce measured reflectance values in response to light received.

Figure 1:
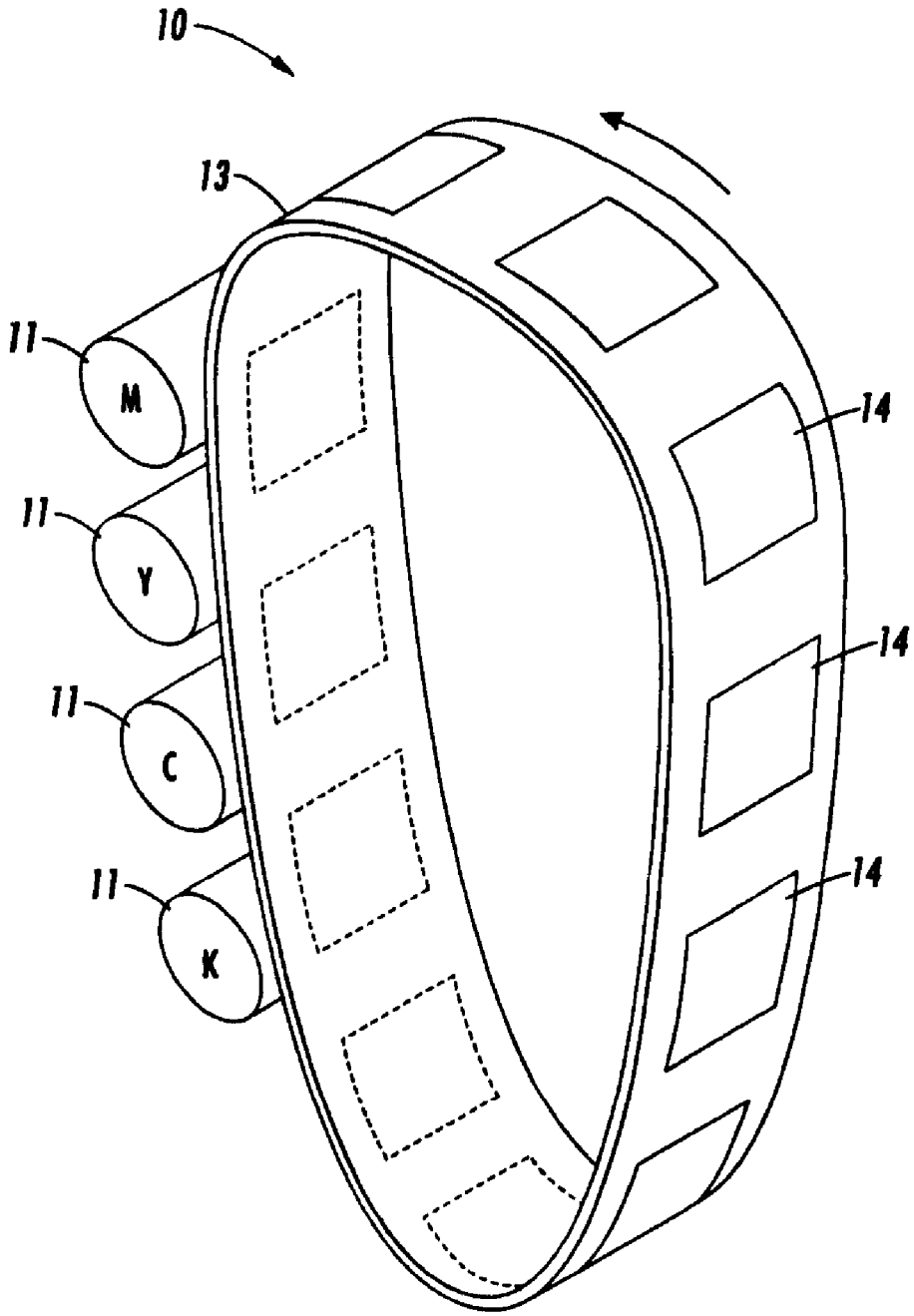
FIG. 1 RELATED ART
FIG. 1 schematically illustrates an Image On Image (IOI) marking engine showing multiple pitches on a photoreceptor belt.
Figure 2:
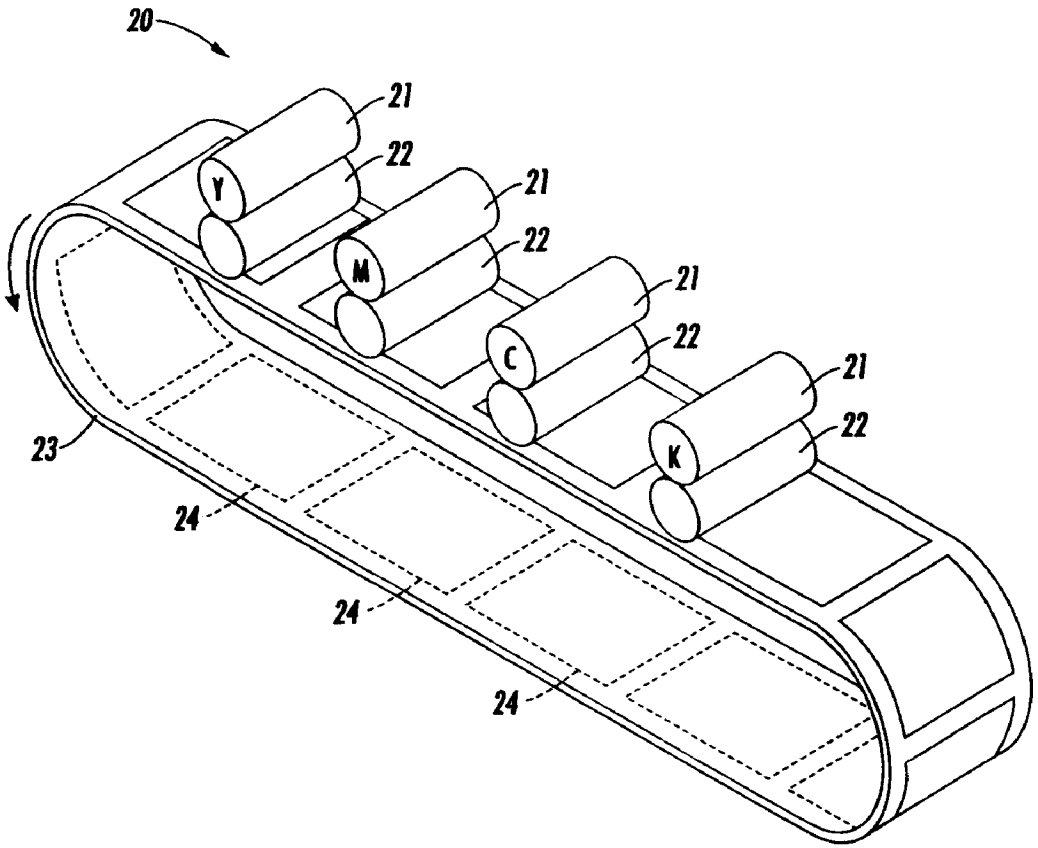
FIG. 2 RELATED ART
FIG. 2 schematically illustrates a tandem marking engine showing multiple pitches on an intermediate transfer belt (ITB)
Figure 9:
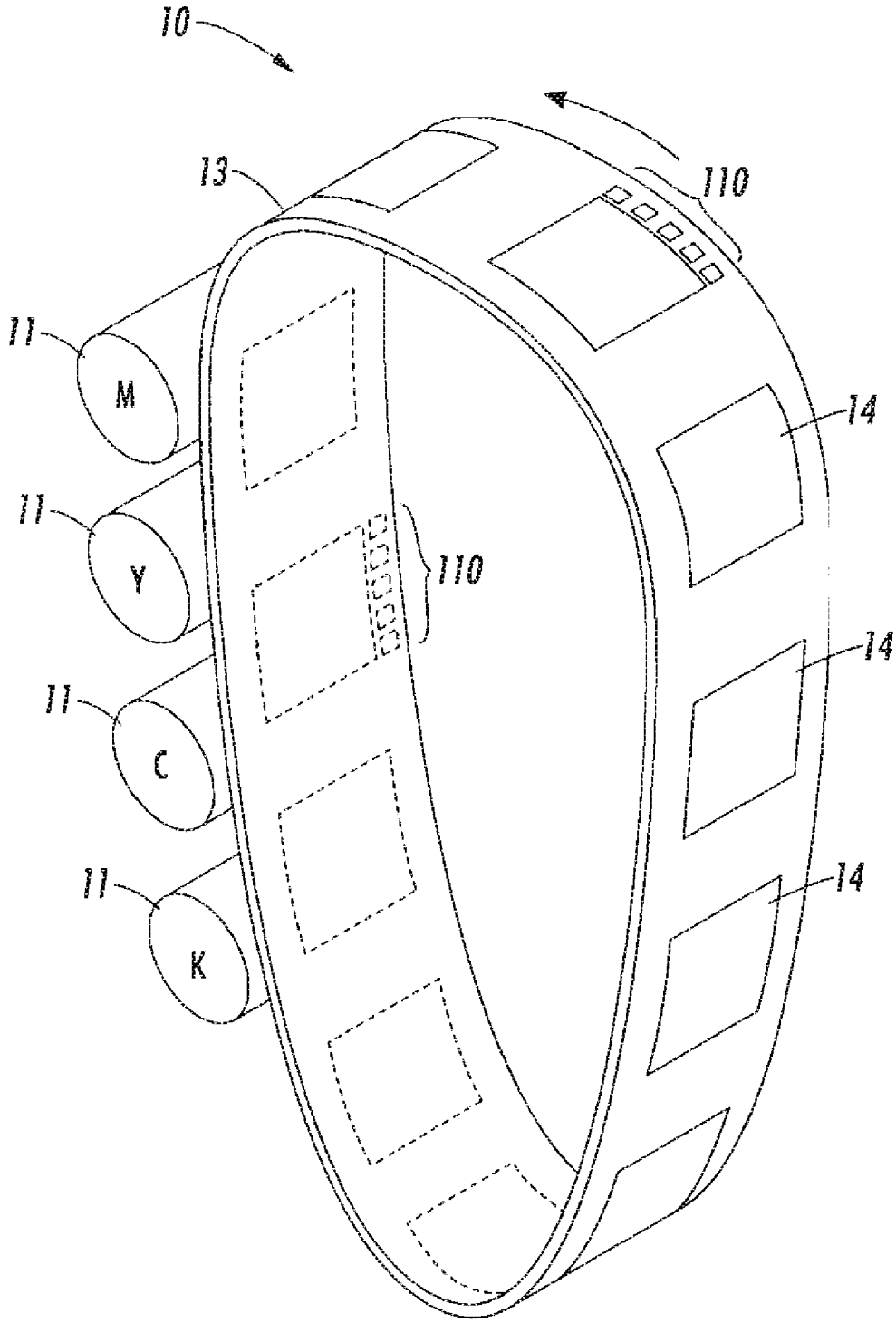
FIG. 9 schematically illustrates an exemplary embodiment of an Image On Inage (IOI) marking engine for use with systems and methods according to this disclosure.
Figure 10:
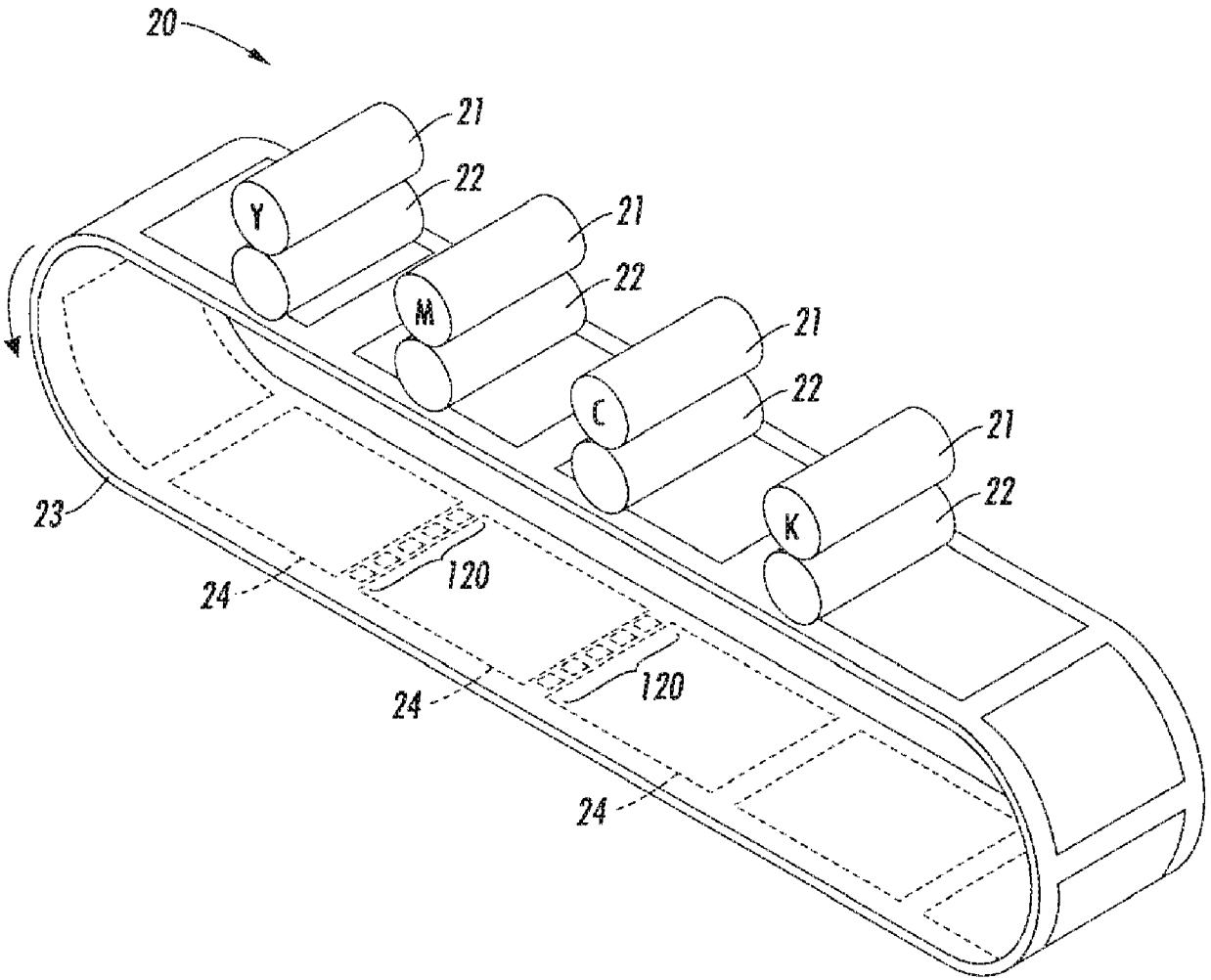
FIG. 10 schematically illustrates a tandem marking engine for use with systems and methods according to this disclosure.
Figure 11:
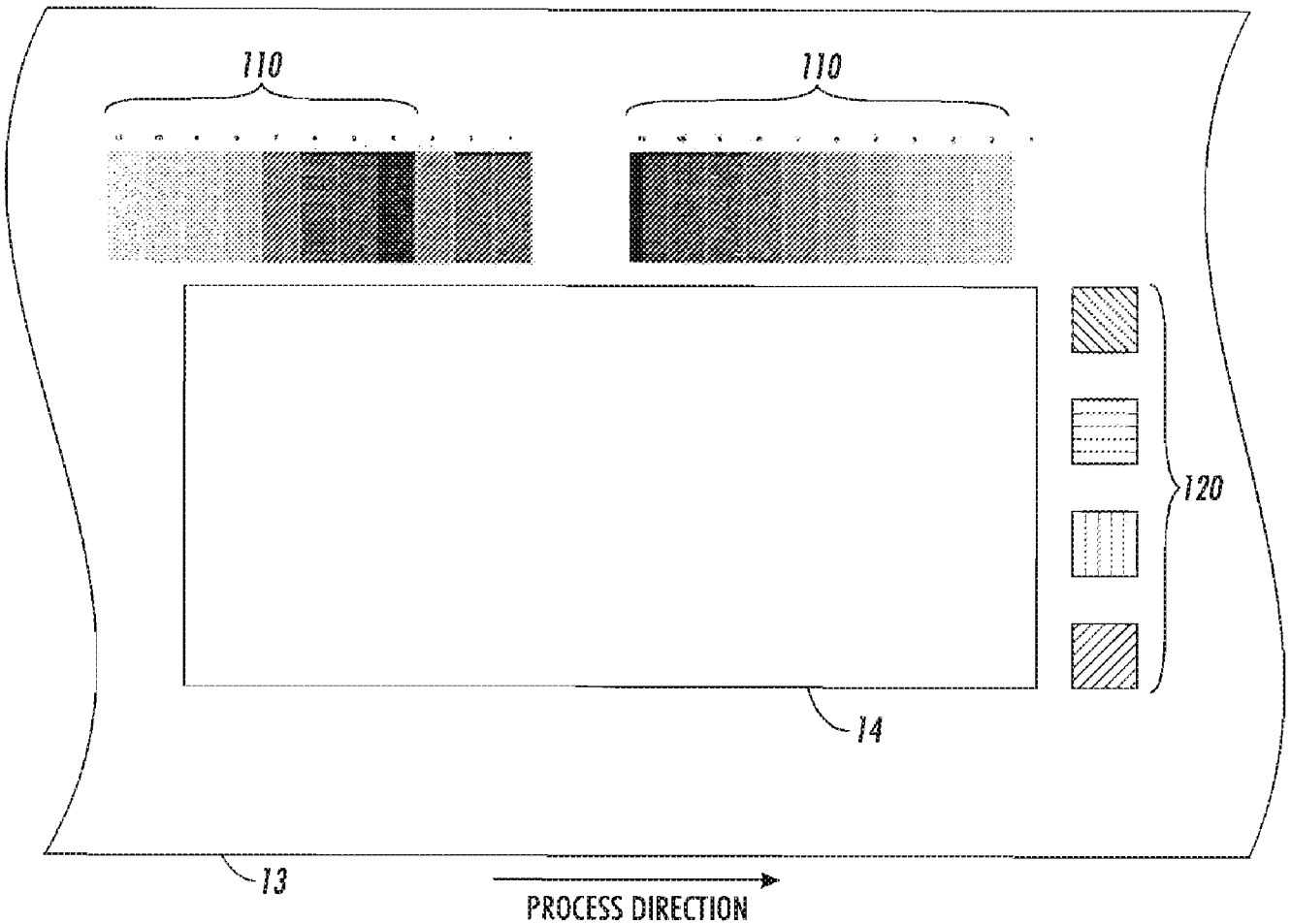
FIG. 11 is a schematic representation of an exemplary pitch and an exemplary set of toned patches for use with the systems and methods according to this disclosure.

FIG. 9 presents a photoreceptor belt similar to the photoreceptor belt depicted in FIG. 11. It should be noted, however, that a set of toned patches 110 are applied by the marking engine adjacent to one or more pitches 14. The toned patches 110 may be placed adjacent to one or more pitches 14 relative to the direction of movement of the photoreceptor belt. FIG. 10 presents a tandem marking engine similar to the marking engine depicted in FIG. 2. It should be noted, however, that a set of toned patches 120 are applied by the tandem marking engine between one or more pairs of pitches 24 placed. FIG. 11 presents a detailed view of toned patches 110 and toned patches 120 placed upon a photoreceptor belt 13 relative to a pitch 14. These pitches and/or toned patches may be used to present colors throughout the color gamut. Details related to the nature and use of toned patches 110 and 120 are described in U.S. patent application Ser. No. 11/428,489.

Figure 12:
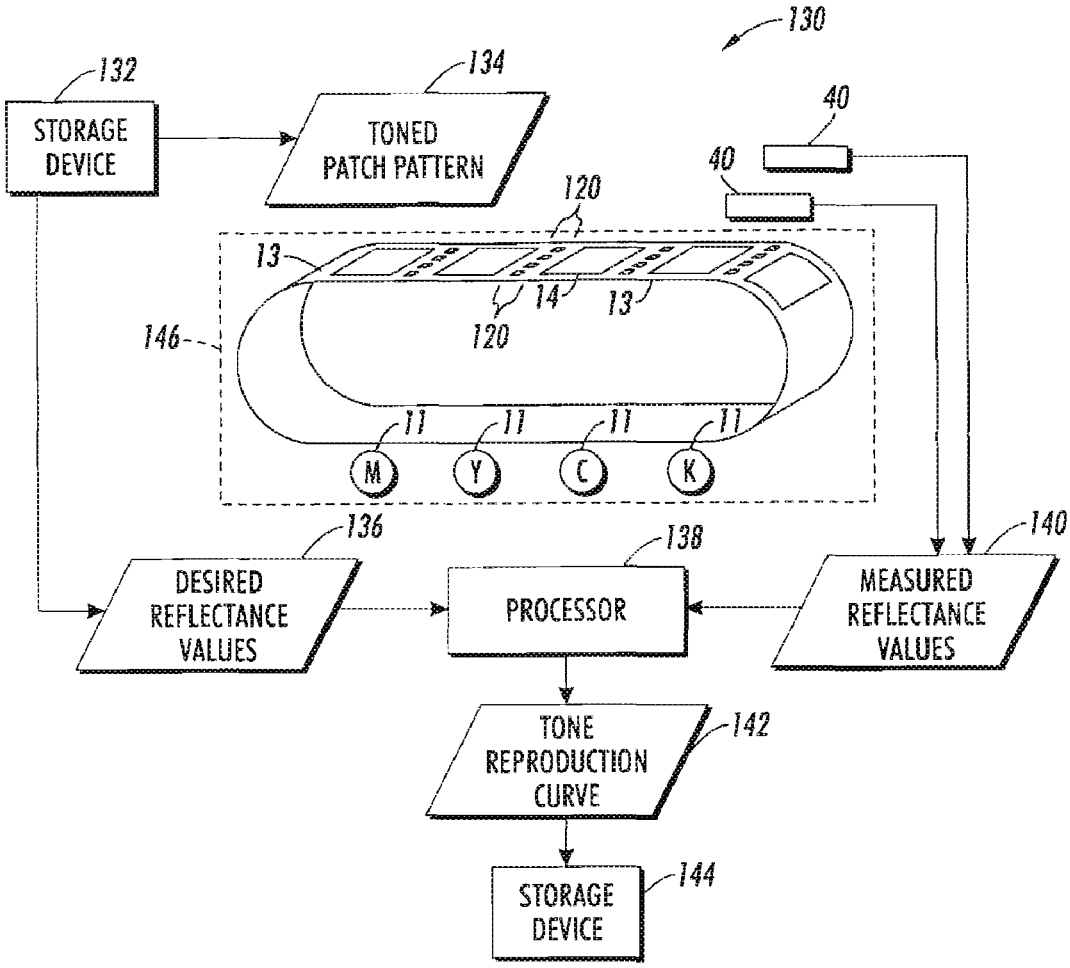
FIG. 12 schematically illustrates a marking engine undergoing calibration according to a process that uses exemplary embodiments of the disclosed sensor.

FIG. 12 schematically illustrates a system 130 including an exemplary marking engine 146 undergoing calibration by producing a TRC based upon feedback received by an exemplary sensor 40, such as spectrophotometer as described above and its associated system as described below. This exemplary method is based on that disclosed in U.S. patent application Ser. No. 11/097,727. A storage device 132 may store a toned patch pattern 134 in the form of data. The toned patch pattern 134 include a number of toned patches and each toned patch may have a desired reflectance value associated with it. The storage device 132 may also store one or more desired reflectance values as data associated with the toned patch pattern 134. A desired actual reflectance value can be determined for any color, including black and/or shades of gray. The marking engine 146 accepts the toned patch pattern 134 and produces toned patches 120 on photoreceptor belt 13. The toned patch pattern 134 may include one or more toned patches 120. Every toned patch 120 is associated with a toned patch pattern 134 and a corresponding desired reflectance because every toned patch 120 results from the printing of a toned patch patterns 134.

As shown in FIG. 12, marking engine 146 may include a photoreceptor belt 13 upon which both pitches 14 and exemplary toned patches 120 are applied. Marking engine 146 may retrieve toned patch patterns 134 from a storage device 132 and use the toned patch pattern data to generate and place toned patches 120 upon photoreceptor belt 13 between or adjacent to pitches 14. Toner may be applied to the respective toned patches 120 and pitches 14 by color applying units 11. One or more sensors 40 may be positioned above photoreceptor belt 13 so that light emitted by LEDs in each sensor 40 may be presented in a collimated beam perpendicular to the photoreceptor surface of the photoreceptor belt 13. In response to an enable signal received from processor 138, the one or more sensors 40 may initiate a sequence which results in each of the one or more sensors 40 measuring reflectance values 140 that may be passed to processor 138. Processor 138 may compare the measured reflectance values 140 with desired reflectance values 136 retrieved from storage device 132. Processor 138 may then generate and/or update TRCs 142 based on differences between the measured reflectance values 140 and the desired reflectance values 136. Generated and/or updated TRC 142 may be stored in storage device 144. TRC 142 may be used by marking engine 146 to control the output of future pitches 14 and toned patches 120 upon photoreceptor belt 13. It should be appreciated that storage devices 132 and 144 may comprise a single storage device within, or otherwise connected to and in communication with, system 130.

Sensors 40, as shown in FIG. 12, may be positioned in any configuration relative to the photoreceptor belt 13 so that toned patches 120 located anywhere upon the photoreceptor belt 13 and/or test images placed within pitches 14 may be analyzed by the one or more exemplary sensors 40. Individual sensors 40 located at different locations within the marking engine 146 may illuminate and may measure reflectance values 140 simultaneously, so long as each sensor 40 is shielded from all other light sources other than the sensor's own LEDs.

Figure 13:
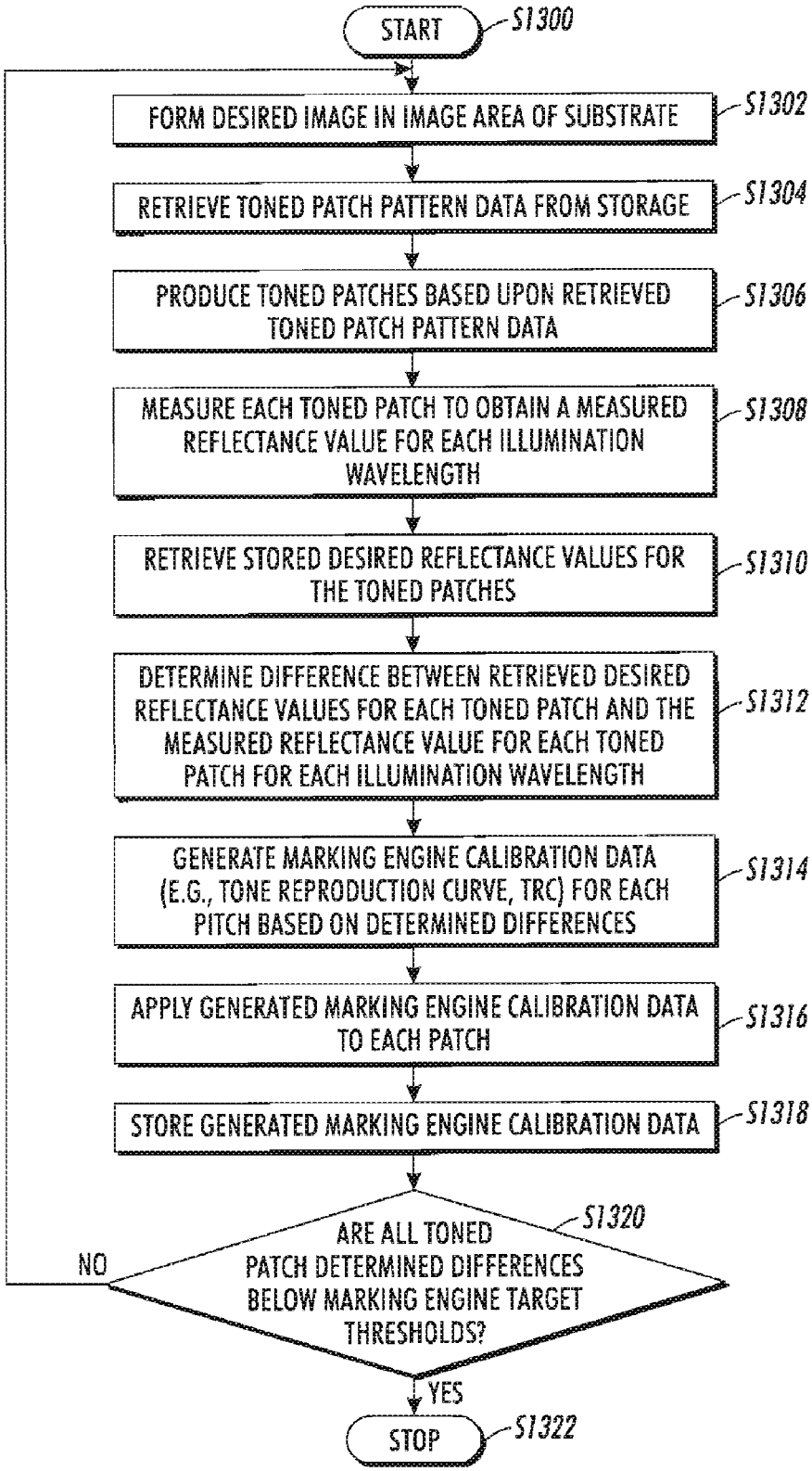
FIG. 13 is a flow diagram of an exemplary method for calibrating a working system according to this disclosure.

FIG. 13 is a flow diagram representing an exemplary method of color calibrating exemplary systems according to this disclosure. An exemplary method of performing an individual color calibration for each pitch will be described based on FIG. 13. As shown in FIG. 13, operation of the method begins at step S1300 and proceeds to step S1302.

In step S1302, a desired image pitch may be formed in a first area of a photoreceptor belt, which is an image area. Operation of the method continues to step S1304.

In step S1304, which may be substantially simultaneous with step S1302, a toned patch pattern, containing data for generating one or more toned patches, is retrieved from a stored memory and provided to a marking engine. Operation of the method continues to step S1306.

In step S1306, the marking engine may produce a toned patch upon a photoreceptor belt based upon the toned patch pattern retrieved from storage. Each toned patch pattern may include one or more toned patches, such as those discussed above in connection with FIG. 11. In exemplary embodiments, and/or for some types of color calibration, it should be appreciated that the toned patch pattern may include only a single toned patch. For example, the toned patch could include a single mixture of color, and a measured reflectance value of the toned patch may be used to develop a calibration value that may be applied by the marking engine for that color. Calibrations for other colors could be performed separately with other toned patches on the same, or in subsequent, belt cycles. Operation of the method continues to step S1308.

In step S1308, the generated patches are illuminated and a reflectance value for each toned patch is measured for each of one or more illumination wavelengths, e.g. 470 nm 940 nm and 970 nm, and made available to a calibration processor. Measured reflectance values may also be stored. Operation of the method continues to step S1310.

In step S1310, desired reflectance values for each of the one or more patches disposed upon the photoreceptor belt for each illumination wavelength may be retrieved from memory storage and made available to a calibration processor. Operation of the method continues to step S1312.

In step S1312, a calibration processor or other like device may determine a difference between retrieved desired reflectance values for each toned patch and corresponding measured reflectance values measured for each toned patch for each illumination wavelength in step S1310. Operation of the method continues to step S1314.

In step S1314, the calibration processor or other like device may generate marking engine calibration data, e.g. a TRC or LUT, for each toner that the marking engine uses. For example, a CMK marking engine may have four TRCs or LUTs. Operation of the method continues to step S1316.

In step S1316, calibration data generated in step S1314 is applied to the marking engine for use in adjusting the amount of toner output by primary color applying units to a photoreceptor unit in response to a requested process color. Operation of the method continues to step S1318.

In step S1318, the generated marking engine calibration data may be stored in a memory store so that the calibration data may be later retrieved and used in subsequent marking operations, e.g. after a marking system restart, to stabilize color variations. Operation of the method continues to step S1320.

In step S1320, differences between retrieved desired reflectance values for each toned patch and corresponding measured reflectance value measured for each toned patch for each illumination wavelength, determined in step S1312, may be compared against a threshold value. Such a threshold represents an acceptable deviation from desired reflectance values, and may, for example, be one or more user configurable values that may be associated with, for example, one or more toned patch patterns and/or one or more desired reflectance values. If the difference is greater than a predetermined threshold, method continues to step S1302 to repeat the calibration process. If the difference is less than or equal to a predetermined threshold, method continues to step S1322 and the process stops.

In the above exemplary method, color-balanced TRCs may be generated using reflectance values measured from toned patches on a photoreceptor belt. For example, color-balanced TRCs may be accurately generated according to embodiments using, for example, mixed CMY gray patches and K patches in a fashion similar to that employed by some prior art methods, such as that disclosed in Mestha et al., "Gray Balance Control Loop for Digital Color Printing Systems," Proceedings of 21$^{st}$ International Conference on Digital Printing Technologies, NIP21, pp. 499-505 (2005), which is incorporated by reference in its entirety. Exemplary embodiments of disclosed systems and methods may use measured reflectance values from relatively few gray and black patches and/or any number of color patch reflectance values obtained directly from a photoreceptor belt in order to construct TRCs more frequently, thus reducing time-dependent drifts in performance.

From the foregoing description, it will be appreciated that the exemplary embodiments of disclosed systems and methods include a novel sensor and color stabilization process that allow reflectance values to be measured from toned patches on a marking system photoreceptor transfer device such as a photoreceptor belt. The approach allows measured reflectance data to be collected at a higher frequency and improved accuracy for use in supporting color stabilization processes. The embodiments described above and illustrated in the drawings represent only a few of the many ways of implementing the described sensor system and methodology and implementing color correction processes based upon an analysis of measured reflectance values from toned patches on a photoreceptor transfer device within a marking engine. These exemplary embodiments are intended to be illustrative and in no way limiting regarding the manner by which such systems and methods may be implemented.

Reflectance values may be measured directly from a photoreceptor transfer device within the marking engine, such as a photoreceptor belt or drum. The sample rate is limited only by the sensitivity of the light sensor and the time necessary to collect sufficient light for a reliable measurement. Therefore, reflectance may be measured one or more times per rotation/revolution of the photoreceptor transfer device, if necessary, to support color stabilization.

The described color stabilization process may be implemented in any number of hardware/firmware/software modules and is not limited by interpretation of any hardware/software architecture described or depicted above. It should be understood that software modules supporting any selected hardware/firmware/software architecture process may be implemented in any desired computer language, and could be developed by one of ordinary skill in the computer and/or programming arts based on the functional description contained herein and flowcharts illustrated in the drawings.

Software modules generally can be composed of two parts. First, a software module may list the constants, data types, variable, routines and the like that that can be accessed by other modules or routines. Second, a software module may be configured as an implementation, which can be private (i.e., accessible perhaps only to the module), and that contains the source code that actually implements the routines or subroutines upon which the module is based. Such software modules can be utilized separately or together to form a program product that can be implemented through signal-bearing media, including transmission media and recordable media.

The described color stabilization process may accommodate any quantity and any type of LUTs, TRCs, and/or data set files and/or databases or other structures containing stored toned patch calibration data, measured reflectance values, and/or intermediate data sets, such as differences between measured reflectance values and stored toned patch calibration data.

Output from the described color stabilization process may be presented to a user in any manner using numeric and/or visual presentation formats. Input from a user may be input in any manner accessible to a user, e.g., a marking system control interface and/or a network connection to the marking system, and may be stored in any manner accessible to the color stabilization process for controlling user configurable data and/or thresholds and/or control parameters used in the color stabilization process.

Further, any references herein of software performing various functions generally refer to computer systems or processors performing those functions under software control. The computer system may alternatively be implemented by hardware or other processing circuitry. The various functions, e.g., amplifying, integrating, storing and processing, of the described color stabilization process may be distributed in any manner among any quantity (e.g., one or more) of hardware and/or software modules or units, computer or processing systems or circuitry, where the computer or processing systems may be disposed locally or remotely of each other and communicate via any suitable communications medium (e.g., LAN, WAN, Intranet, Internet, hardwire, modern connection, wireless, etc.). The processes described above and illustrated in the flow charts and diagrams may be modified in any manner that accomplishes the functions described herein.

Toned patches are not limited to any particular color, color combination or shade of black or gray. The described sensor may be used to measure accurate reflectance values from any toned patch, including single-color patches, mixed-color patches and multi-separation image-on-image colors.

Lenses used to receive and focus light reflected from a toned patch are not limited to being mounted at an angle optimized to receive light reflected at 45 degrees, but may be mounted at any angle that brings in sufficient light. If multiple lens/light sensor combinations are used, the lenses need not be mounted at precisely the same angle, but may be mounted at other angles as well, so long as the selected angles allow sufficient light to be received at the illumination intensity and integration period desired.

Sensor capabilities may include single or multiple spectrophotometer devices mounted within a marking system to allow measured reflectance values to be generated from one or several locations within the marking system. If reflectance values are collected simultaneously by multiple spectrophotometer devices, these devices may preferably be light isolated, so that a measured reflectance value is in response light emitted from the same spectrophotometer device used to generate the reflectance value.

In exemplary embodiments, the voltage source used to drive illumination sources, e.g. LCLEDs, may be pulsed at a level above what is sustainable in a continuous current mode, thereby producing higher flux detection signals and allowing a toned patch to be interrogated in a shorter time period. Further, by integrating output of the light sensor over one or more illumination periods, enhanced signal to noise ratios can be achieved.

While the LEDs in exemplary embodiments, described above, are turned on one at a time in sequence, it will be appreciated that the system is not limited thereto. There may be measurement modes in which it is desirable to turn on more than one LED or other illumination source, simultaneously, on the same toned patch.

Toned patches may be discretely applied to a photoreceptor transfer device at any location outside the respective pitch areas. Further, embodiments described above, use toned patches as the means by which reflectance values are measured. In such a manner, color correction processes may be supported without interfering with image process flow. Toned patches may alternatively be applied as, for example, test images within pitches. Reflectance values for such test images may be generated from one or more exemplary sensors, such as a spectrophotometer positioned over the pitch area of the photoreceptor transfer device. Such test images may be transferred to an output substrate or removed from the photoreceptor transfer device without being transferred to an output substrate.

The use of toned patches and sensors for measuring reflective values may be initiated at any time, either manually or automatically during or outside image forming operations to support a color stabilization process.

Although photodiodes are used as examples of light sensors used within exemplary embodiments of the disclosed sensor system the light sensor used are not limited to any particular technology.

Figure 3:
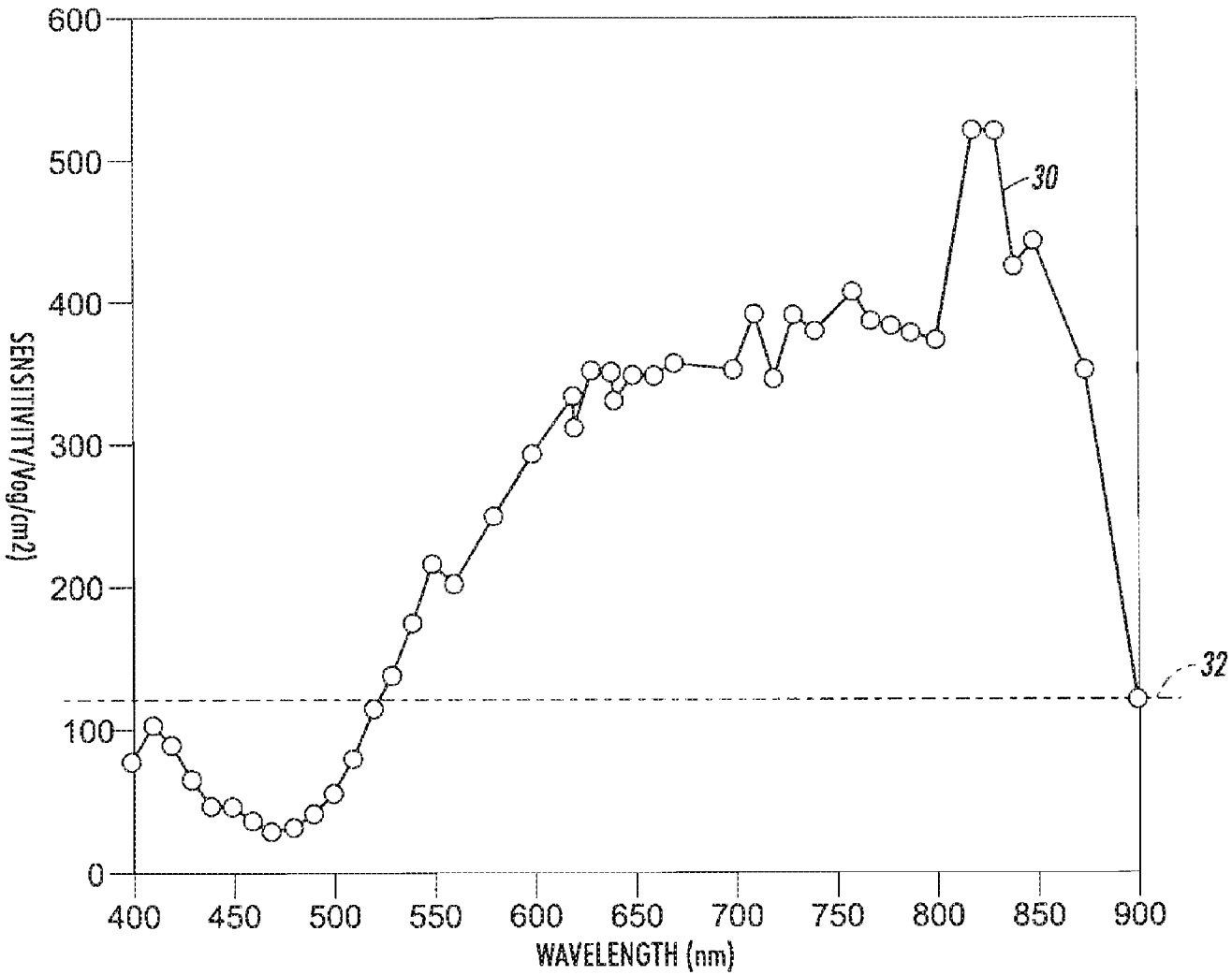
FIG. 3 is a graphical plot of the spectral sensitivity of an exemplary photoreceptor belt.

Illumination wavelengths are not limited to any specific wavelengths, so long as the wavelengths used are outside of sensitivity range of the photoreceptor transfer device and, therefore do not result in ghosting. Wavelengths may be selected based upon the spectral response curve of the photoreceptor transfer device. The spectral response shown in FIG. 3 is exemplary only. Similar spectral response curves for other photoreceptor transfer devices are commercially available and/or may be easily obtained and, therefore, wavelengths for which the photoreceptor transfer device is only nominally responsive may be easily determined.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of calibrating a marking engine that includes a photoreceptor transfer device having at least a first area on a surface of the photoreceptor transfer device, the at least first area receiving at least one color of marking material that is a portion of an image, the photoreceptor transfer device conveying the marking material to at least one of another transfer device or an output substrate, the method comprising:

disposing at least one toned patch in a second area of the photoreceptor transfer device, the second area being located on the surface of the photoreceptor transfer device; and illuminating the disposed toned patch or image;

measuring a reflectance value for the toned patch or image to obtain a measured reflectance value for the toned patch or image in response to the illumination; and based on the measured reflectance value, performing a color calibration for use in a marking operation, wherein illuminating the at least one toned patch or image comprises illuminating the at least one toned patch or image with an illumination wavelength outside the photo response range of the photoreceptor transfer device.

2. The method of claim 1, wherein disposing the at least one toned patch comprises:

retrieving a toned patch pattern stored in a memory device for the at least one toned patch; and disposing the at least one toned patch on the photoreceptor transfer device based upon the retrieved toned patch pattern.

3. The method of claim 2, wherein disposing the at least one toned patch further comprises disposing the at least one toned patch separately for each primary color used by the marking engine.

4. The method of claim 1, wherein the at least one toned patch comprises at least one of a single-color patch, a mixed-color patch, or a multi-separation image-on-image color patch.

5. The method of claim 1, wherein illuminating the at least one toned patch or image with an illumination wavelength outside the photo response range of the photoreceptor transfer device includes, selecting an illumination source that emits illumination at a wavelength for which the photoreceptor generates a number of electron-hole pairs below a predetermined threshold determined for the photoreceptor transfer device.

6. The method of claim 5, wherein the predetermined threshold may be any value below which ghosting is not observed in subsequent toned patches and output image pitches.

7. The method of claim 1, wherein performing the calibration comprises:

determining a tone reproduction curve for a pitch based on the measured values; and applying the determined tone reproduction curve to the pitch.

8. The method of claim 1, wherein measuring a reflectance value comprises integrating the output of a light sensor over a period of illumination to produce a measured reflectance value.

9. The method of claim 1, the second area being outside the plurality of first areas.

10. The method of claim 1, the second area being inside at least one of the plurality of first areas.

11. A method of calibrating a marking engine that includes a photoreceptor transfer device having at least a first area on a surface of the photoreceptor transfer device, the at least first area receiving at least one color of marking material that is a portion of an image, the photoreceptor transfer device conveying the marking material to at least one of another transfer device or an output substrate, the method comprising:

disposing at least one toned patch in a second area of the photoreceptor transfer device, the second area being located on the surface of the photoreceptor transfer device; and illuminating the disposed toned patch or image;

measuring a reflectance value for the toned patch or image to obtain a measured reflectance value for the toned patch or image in response to the illumination; and based on the measured reflectance value, performing a color calibration for use in a marking operation, wherein illuminating the toned patch or image comprises illuminating the toned patch or image with a wavelength below 500 nm or above 900 nm.

12. The method of claim 11, wherein the wavelength is below 500 nm.

13. The method of claim 11, wherein the wavelength is above 900 nm.

14. A marking system comprising:

a photoreceptor transfer device that includes a plurality of first areas receiving at least one color of marking material that is a portion of an image and conveying the marking material to one of another transfer device or to an output substrate and a plurality of second areas receiving a toned patch;

a first storage device adapted to store a toned patch pattern for a toned patch;

a marking engine that marks a desired image in at least one of the plurality of first areas, and marks a toned patch in at least one of the plurality of second areas of the photoreceptor transfer device based on the stored toned patch pattern;

at least one illumination source that illuminates the toned patch or image;

a monitoring circuit that measures a reflectance value for the toned patch or image to obtain a measured reflectance value for the toned patch or image; and a calibration processor that, based on the measured reflectance value, performs a color calibration for use in a marking operation, wherein the calibration processor determines at least one tone reproduction curve based on a plurality of measured reflectance values, and the at least one illumination source illuminates a toned patch or image with an illumination wavelength outside the photo response range of the photoreceptor transfer device.

15. The system of claim 14, wherein the at least one illumination source selects an illumination source that emits illumination at a wavelength for which the photoreceptor generates a number of electron-hole pairs below a predetermined threshold determined for the photoreceptor transfer device.

16. The system of claim 15, wherein the predetermined threshold may be any value below which ghosting is not observed in the plurality of first areas or output image pitches.

17. The system of claim 14, wherein the illumination source is a spectrophotometer, comprising:

an illumination control circuit that controls illumination of the spectrophotometer;

a collimating lens that collimates light in the spectrophotometer to direct collimated light in a direction that is orthogonal to the toned patch or image upon the photoreceptor transfer device; and at least one light receptor lens arranged in the spectrophotometer to receive light reflected from the toned patch or image, and to focus the reflected light upon at least one light sensor associated with the light receptor lens.

18. The system of claim 17, the spectrophotometer further comprising:

a plurality of at least one light receptor lenses arranged in a circular configuration centered upon the collimating lens, to receive light reflected from the toned patch or image at approximately a 45 degree angle, and to focus the reflected light upon a light sensor associated with each light receptor lens.

19. The system of claim 17, wherein the illumination control circuit controls each of a plurality of light sources to illuminate individually.

20. The system of claim 17, wherein the light sensor is a multiple photo-site photodetector.

21. The system of claim 17, wherein the illumination control circuit integrates a signal received from the light sensor over a duration that an individual illumination source is illuminated to produce a measured reflectance value.

22. An image forming device comprising the system of claim 14.

23. A xerographic image forming device comprising the system of claim 14.

* * * * *